US010928104B2

(12) United States Patent
Clark

(10) Patent No.: US 10,928,104 B2
(45) Date of Patent: Feb. 23, 2021

(54) WATER-COOLED CARBON DIOXIDE REFRIGERATION SYSTEM

(71) Applicant: ISENTRA LTD, Preston (GB)

(72) Inventor: Daniel Clark, Preston (GB)

(73) Assignee: ISENTRA LTD., Preston (GB)

( * ) Notice: Subject to any disclaimer, the term of this patent is extended or adjusted under 35 U.S.C. 154(b) by 0 days.

(21) Appl. No.: 15/767,140

(22) PCT Filed: Oct. 7, 2016

(86) PCT No.: PCT/GB2016/053138
§ 371 (c)(1),
(2) Date: Apr. 9, 2018

(87) PCT Pub. No.: WO2017/060733
PCT Pub. Date: Apr. 13, 2017

(65) Prior Publication Data

US 2018/0320934 A1 Nov. 8, 2018

(30) Foreign Application Priority Data

Oct. 8, 2015 (GB) ..... 1517845

(51) Int. Cl.
*F25B 9/00* (2006.01)
*F25B 7/00* (2006.01)
*F25B 25/00* (2006.01)

(52) U.S. Cl.
CPC ..... *F25B 9/008* (2013.01); *F25B 7/00* (2013.01); *F25B 25/005* (2013.01); *F25B 2339/047* (2013.01)

(58) Field of Classification Search
CPC ... F24F 5/0096; F24F 2221/183; F24D 17/02; F24D 11/0214; F24D 19/1072;
(Continued)

(56) References Cited

U.S. PATENT DOCUMENTS 4,111,259 A * 9/1978 Lebduska ..... F24D 11/0221 237/1 R
6,405,551 B1 * 6/2002 Kuwabara ..... F24D 17/02 62/238.7

(Continued)

FOREIGN PATENT DOCUMENTS

EP 0908688 A2 4/1999
EP 0908688 A3 * 3/2002 ..... F25B 9/008

(Continued)

OTHER PUBLICATIONS

International Search Report—PCT/GB2016/053138 dated Feb. 23, 2017.

*Primary Examiner* — Frantz F Jules
*Assistant Examiner* — Martha Tadesse
(74) *Attorney, Agent, or Firm* — Daniel A. Tanner, III; James E. Golladay, II; TannerIP PLLC

(57) ABSTRACT

A refrigeration system including a primary stage and a secondary stage, the primary and secondary stages being thermally coupled to one another via a first heat exchanger. The primary stage including a closed-loop CO2 refrigeration system having a primary evaporator located in a region to be cooled, a primary compressor and a water-cooled primary condenser that forms at least a part of the first heat exchanger and being water-cooled by the secondary stage. The secondary stage including a closed-loop water-based cooling system having the first heat exchanger, a pump adapted to pump cooling water around the secondary stage, and a heat sink. Temperature at the (final) heat sink of the system does not need to be maintained below the supercritical temperature of the refrigerant, thus the primary (CO2) stage is operated below its supercritical temperature-pressure regime at relatively high ambient temperatures.

8 Claims, 7 Drawing Sheets

(58) Field of Classification Search
CPC ... F24D 3/08; F24D 3/082; F24D 3/18; Y02B 30/12; F25B 7/00; F25B 9/008; F25B 25/005; F25B 2339/047; F25B 30/06; F25B 2309/061; F25B 2313/003
See application file for complete search history.

(56) References Cited

U.S. PATENT DOCUMENTS

| | | | | |
|---|---|---|---|---|
| 2007/0056312 | A1* | 3/2007 | Kobayashi | F25B 9/008 62/335 |
| 2010/0281882 | A1* | 11/2010 | Heinbokel | F25B 9/008 62/3.2 |
| 2014/0326014 | A1* | 11/2014 | Kim | F24H 9/0005 62/238.7 |
| 2016/0116172 | A1* | 4/2016 | Goransson | F24D 3/087 62/238.7 |

FOREIGN PATENT DOCUMENTS

| | | | | | |
|---|---|---|---|---|---|
| EP | 2770278 | A1 | | 8/2014 | |
| JP | 2003056905 | A | * | 2/2003 | |
| JP | 2004190917 | A | * | 7/2004 | F25B 9/008 |
| JP | 2004190917 | A | | 7/2004 | |
| JP | 2009243768 | A | * | 10/2009 | |
| JP | 2009243768 | A | | 10/2009 | |

* cited by examiner

WATER-COOLED CARBON DIOXIDE REFRIGERATION SYSTEM

CROSS-REFERENCE TO RELATED APPLICATIONS

This application is the U.S. National Phase of International Application No. PCT/GB2016/053138, filed 7 Oct. 2016, which claims priority from, and so this application claims the benefit of, UK Patent Application No. GB1517845.2, filed 8 Oct. 2015, which issued as UK patent No. GB2543086 on 3 Apr. 2018.

BACKGROUND OF THE INVENTION

This invention relates to refrigeration, and in particular, to carbon dioxide (hereinafter "CO2", but sometimes referred to as "R744") refrigeration systems.

Known refrigeration systems are variously described in the following published patents and patent applications: EP1983276 [DRESDNER, 22 Oct. 2008]; US2001/023594 [IVES, 27 Sep. 2001]; JP2012145254 [MITSUBISHI ELECTRIC CORP., 20 Aug. 2012]; US2007/056312 [KOBAYASHI MAKOTO, 15 Mar. 2007]; JP2004190917 [SANYO ELECTRIC CO, 8 Jul. 2004]; JP2009243768 [SANDEN CORP, 22 Oct. 2009]; EP0908688 [COSTAN SPA, 14 Apr. 1999]; and EP2770278 [PANASONIC CORP, 27 Aug. 2014].

CO2 refrigeration systems are a preferred choice in many commercial refrigeration applications, such as in the fridge/freezer departments of supermarkets, due to their improved environmental credentials compared with alternatives, such as Freon-based refrigerant systems.

A typical CO2 refrigeration system comprises, in common with most refrigeration systems, a evaporator located in the region to be refrigerated, a compressor driving a refrigerant (in this case CO2) around a closed loop system, to a condenser located away from the evaporator. Heat in the region to be cooled is drawn into the refrigeration system by the evaporator. The refrigerant is heated in the evaporator and vaporizes. By moving the refrigerant around the closed-loop system, the heat absorbed by the refrigerant at the evaporator is transported to the compressor. The refrigerant is then re-compressed by the compressor and is sent back to the condenser, where the refrigerant is liquefied through cooling by any suitable means, such as by a fan. The condenser rejects heat in the refrigerant into a region surrounding the condenser. By such means, heat can be moved/extracted from the region to the refrigerated, and rejected elsewhere, for example, into the region surrounding the condenser.

In known commercial CO2 refrigeration systems, the pipework between the condenser/gas cooler (heat rejecters in CO2 systems are often termed "gas coolers" because when operating trans critically, the gas doesn't condense into a liquid) and the evaporator can be very long, which leads to difficulties in installation and maintenance, especially where the refrigerant pipework needs to be routed around a building. CO2 pipework tends to be expensive, and, due to the required pressure ratings, requires careful design and continuous maintenance to avoid degradation over time, or leaking. A leak in any of the CO2 refrigerant pipework, which may go undetected for some time, can be very difficult to diagnose and remedy.

A further problem with CO2 refrigeration systems is that the supercritical temperature of the CO2, in the range of pressures used in conventional, or non-CO2, refrigeration systems is quite low: typically around 30 degrees centigrade. Above the supercritical temperature, the refrigerant (CO2) undergoes a phase change into a supercritical fluid, which vastly decreases its efficiency as a refrigerant. The solution to this is to operate the refrigerant at greatly increased discharge pressures, but this requires much more physically substantial and powerful compressors, also much more complicated (high-pressure) pipework, and so the efficiency gains associated with using CO2 as a refrigerant in the first place are quickly cancelled out by the increase in working pressure that is required.

As such, CO2 refrigeration systems are rarely used where the ambient temperature surrounding the condenser/gas cooler regularly exceeds approximately 25 degrees centigrade, which effectively rules-out single stage CO2 refrigeration systems in many parts of the world.

A further problem with known refrigeration systems is that the heat from the region to be refrigerated is effectively wasted: being rejected to the air outside a building in many cases, whereas there may be a need to efficiently harvest and adaptively use that heat elsewhere, for example, in a central heating system.

A need therefore exists for a solution to one or more of the above problems and/or for an alternative to known CO2 refrigeration systems.

SUMMARY OF THE INVENTION

The invention is set forth in the appended independent claim. Preferred or optional features of the invention are set forth in the appended dependent claims.

The present disclosure provides a refrigeration system comprising primary and secondary stages thermally coupled to one another via a first heat exchanger; the primary stage comprising a closed-loop CO2 refrigeration system comprising a primary evaporator located in a region to be cooled, a primary compressor and a primary condenser/gas cooler being the first heat exchanger; and the secondary stage comprising a closed-loop refrigeration system comprising a secondary evaporator being the first heat exchanger, a secondary compressor and a heat sink.

In the context of this disclosure, the term "heat sink" means a device, such as a heat exchanger, that can either absorb or reject heat. In the context of this disclosure, the term "evaporator" encompasses both dry expansion (DX) evaporators and flooded evaporators. Further, in the context of this disclosure, the term "closed-loop" system means that the refrigerant circulates within the system and is recycled and can be a dry expansion (DX) system or a flooded system as will be well-understood by persons skilled in the art.

The secondary evaporator functions to water-cool the primary condenser/gas cooler, and in a closed loop water-cooling system would not, technically be an "evaporator" as the cooling water does not change phase. However, functionally, the secondary evaporator acts as such in the sense that it draws heat from the primary condenser/gas cooler.

The invention thus differs from known CO2 refrigeration systems insofar as there are two refrigeration stages, namely a primary CO2 refrigeration stage and a secondary water-based refrigeration or chiller stage. Such a configuration suitably enables the primary (CO2) stage to operate sub-critically permanently, be relatively compact and/or located close to the region to be cooled, whereas the secondary stage can be located elsewhere.

By providing the first heat exchanger between the primary and secondary stages, it is possible to use water as the heat exchange medium (refrigerant) in most of the system, which can greatly simplify the installation, maintenance and decommissioning of the system. Specifically, water pipes are relatively inexpensive and straightforward to install and maintain: they can be installed and maintained by ordinary plumbers; whereas the CO2 pipework requires specialist installation/maintenance engineers. Further, a leak in a water-based part (which forms the majority of) the system is usually relatively inconsequential (compared with a CO2 leak). Thus, the invention potentially provides a more robust system, and one in which a failure is less likely to have adverse environmental or health and safety implications.

The invention may provide a modular system comprising a primary stage unit that can be sited at or near to the region to be refrigerated, and a secondary stage that can be sited elsewhere. The primary stage unit is suitably a self-contained unit that can function independently of the secondary stage, subject to the temperature of the first heat exchanger being maintained below the CO2 supercritical temperature.

One of the main advantages of the invention, however, is suitably that, provided the temperature at the first heat exchanger can be maintained below the supercritical temperature of the CO2 refrigerant, the primary (CO2) stage can be operated sub-critically, i.e. below its supercritical temperature-pressure regime, and hence more efficiently. In other words, the temperature at the (final) heat sink of the system does not need to be maintained below the supercritical temperature of the CO2 refrigerant, thus meaning that the system can be used where the ambient temperature is above the supercritical temperature of the CO2 refrigerant, unlike known CO2 refrigeration systems which become inefficient or ineffective when the ambient temperature (e.g. of the air surrounding the heat sink) exceeds the supercritical temperature of the CO2 refrigerant.

Suitably, the first heat exchanger comprises a plate heat exchanger, a shell-and-tube or any other suitable type of heat exchanger.

The primary stage comprises a closed-loop CO2 refrigeration system in which the primary evaporator, a primary compressor and primary condenser/gas cooler (first heat exchanger) are interconnected by CO2 tubes that are at least partially filled with compressed CO2 fluid.

Suitably, the secondary stage comprises a closed-loop water refrigeration system in which the first heat exchanger (acting as the secondary evaporator or cooler for the primary condenser/gas cooler, secondary compressor/pump and heat sink are interconnected by water pipes that are at least partially filled with a water-based heat transfer fluid. The water-based heat transfer fluid can comprise pure water (e.g. distilled water), or it may contain one or more additives, such as a surfactant, a heat capacity-altering additive, an anti-corrosion additive and/or an anti-freeze additive.

The heat sink is the evaporator of a heat pump, which comprises a dry air cooler or an air side heat exchanger (the two terms being interchangeable in the context of this disclosure). The use of a dry air cooler or air side heat exchanger enables the heat pump to reject heat from the primary stage to ambient air, and it will be appreciated that the ambient air must be low enough to maintain the temperature at the first heat exchanger below the supercritical temperature of the CO2 refrigerant for this to be efficient. The ambient temperature in this first mode or operation is typically below approximately 12-15 degrees centigrade. However, in temperate climates, such as in the Northern Hemisphere (e.g. northern Europe), this condition will be satisfied most of the time. However, when the ambient temperature exceeds a point where the temperature at the first heat exchanger cannot be maintained below the supercritical temperature of the CO2 refrigerant, supplementary heat extraction is indicated.

In one embodiment, supplementary heat extraction can be achieved by connecting in-line with the dry air cooler or air side heat exchanger, a second heat exchanger forming part of a heat pump. Suitably, the heat pump comprises an evaporator, being the second heat exchanger, a heat pump compressor and a heat pump condenser. The heat pump suitably works to change the "grade" of the heat, i.e. to cool the heat pump evaporator (second heat exchanger), which extracts heat from the closed-loop of the secondary stage of the system before it is returned to the first heat exchanger.

The hot side outlet of the heat pump condenser is connected to the hot side inlet of the dry air cooler or air side heat exchanger, and the cold outlet of the hot side of the heat pump condenser is connected to the cold side outlet of the dry air cooler or air side heat exchanger. Such a configuration means that the dry air cooler or air side heat exchanger (or an arrangement of dry air cooler or air side heat exchangers) can be used to simultaneously cool the first heat exchanger and the heat pump condenser. This configuration, or mode of operation may be suitable where, for example, the ambient temperature is between approximately 12 and 30 degrees centigrade. It will be appreciated that by altering the relative flow rates of the coolant in the part of the circuit between the first heat exchanger and the dry air cooler or air side heat exchanger; and in the part of the circuit between the heat pump condenser and the dry air cooler or air side heat exchanger, it is possible to optimise the system to achieve acceptable cooling of the hot side of the first heat exchanger to enable the CO2 refrigeration stage to operate sub-critically and efficiently.

Additionally or alternatively, acceptable cooling of the hot side of the first heat exchanger (to enable the CO2 refrigeration stage to operate efficiently) could be achieved by controlling the speed of the fan of the dry air cooler or air side heat exchanger and/or by controlling the condensing temperatures.

At elevated temperatures, say above 30 degrees Centigrade ambient air temperature, it is not possible to use the dry air cooler or air side heat exchanger for first heat exchanger cooling. However, the heat pump arrangement described above can be used to address this problem in another mode of operation. Specifically, by forming now separate closed loop circuits between the first heat exchanger and the heat pump evaporator (second heat exchanger); and between the heat pump condenser and the dry air cooler or air side heat exchanger, it is possible to "upgrade" the heat within the heat pump to give an output temperature (at the hot side of the heat pump) to a temperature that is sufficiently higher than ambient air temperature. This has two effects: first, it cools the heat pump condenser sufficiently to cool the hot side of the first heat exchanger to a temperature below the supercritical temperature of the CO2 refrigerant; and second, it increases the temperature at the hot side of the dry air cooler or air side heat exchanger to enable the dry air cooler or air side heat exchanger to reject heat to the ambient air despite the elevated ambient air temperature.

In another mode of operation, the hot side of the heat pump, i.e. the heat pump condenser, may form a third heat exchanger of a heat recovery system. The heat recovery system can comprise a heat store, such as a central heating system, into which heat from the first heat exchanger is ultimately rejected. By using the invention in this mode of operation, unwanted heat from the region surrounding the evaporator of the primary refrigeration stage can be used to heat a building, or can be stored (e.g. in a hot water tank) for later use.

In a yet further mode of operation, for example, where it is not desired to use all of the unwanted heat from the region surrounding the evaporator of the primary refrigeration stage to heat a building, or for hot water, the dry air cooler or air side heat exchanger can be used in conjunction with the heat recovery system. By varying the dry air cooler or air side heat exchanger fan speeds, it may be possible to adjust the relative amounts of heat recovery and heat rejection, to suit user requirements.

This is one feature of the invention that is not possible with existing multi-stage refrigeration systems because in known multi-stage refrigeration systems, if the user only requires a proportion of the available heat, the compressor discharge pressure of the entire CO2 mass flow rate is increased from optimum, in-order to raise the CO2 temperature and create a temperature differential necessary for heat exchange to the heating water.

In other words, in the known systems, if less than 100% of the available heat is required, inefficiencies are introduced because the entire mass flow rate of the CO2 refrigeration system needs to be altered to create temperature differentials necessary to facilitate heat exchange. This naturally introduces an inherent energy wastage when recovering heat from known multi-stage refrigeration systems. However, the invention may facilitate user selection of heat recovery between 0% heat recovery (modes 1-3), 100% heat recovery (mode 4) and partial heat recovery (mode 5) without effecting the optimised CO2 running conditions.

In a yet further mode or operation, the heat sink of the invention can be used in reverse to scavenge heat from the ambient air. This may be desirable where the heat pump condenser is insufficiently hot, for example, where the rate of refrigeration in the primary stage is too low to produce sufficient heat at the heat pump evaporator to meet demand. In this situation, the dry air cooler or air side heat exchanger can be connected in parallel, and in reverse, to the first heat exchanger, so that it draws heat from the ambient air thus raising the inlet temperature at the inlet of the heat pump evaporator.

Possible advantages associated with certain embodiments of the invention may include:

Overcoming certain limitations and efficiency shortfalls of known CO2 refrigeration systems operating in medium to high ambient temperatures, whilst simultaneously providing a fundamentally versatile and optimised year-round heat recovery system;

Keeping the CO2 refrigeration system operating in its highly effective sub-critical state, thereby avoiding substantial trans-critical inefficiencies and the associated need for vastly oversized compressors;

Reducing CO2 system pressures and the need for high specification gas cooler pipe work;

Enabling, where provided, the heat pump to be passive, thus leaving the CO2 system to operate and reject heat independently;

At higher ambient temperatures, the heat pump may dynamically supplement ambient cooling;

Reduced overall power consumption by optimising the pressures and/or flow rates in the CO2 system and the heat pump;

The ability to delivering a wide range of heating capacity and temperature gradients without any effect to the normal operation or efficiency of the CO2 refrigeration system;

Avoiding artificially inflated CO2 operating conditions in heat recovery modes of operation;

The ability to scavenge heat should there be a heating capacity demand greater than the heat available for recovery; and System simplification: all the aforementioned modes of operation can be achieved using a single external air side heat exchanger.

BRIEF DESCRIPTION OF THE DRAWINGS

An exemplary embodiment of the invention shall now be described, by way of example only, with reference to FIGS. 1 to 6 of the drawings, which respectively show an embodiment of the invention operating in six different modes.

DETAILED DESCRIPTION OF THE INVENTION

Figure 1:
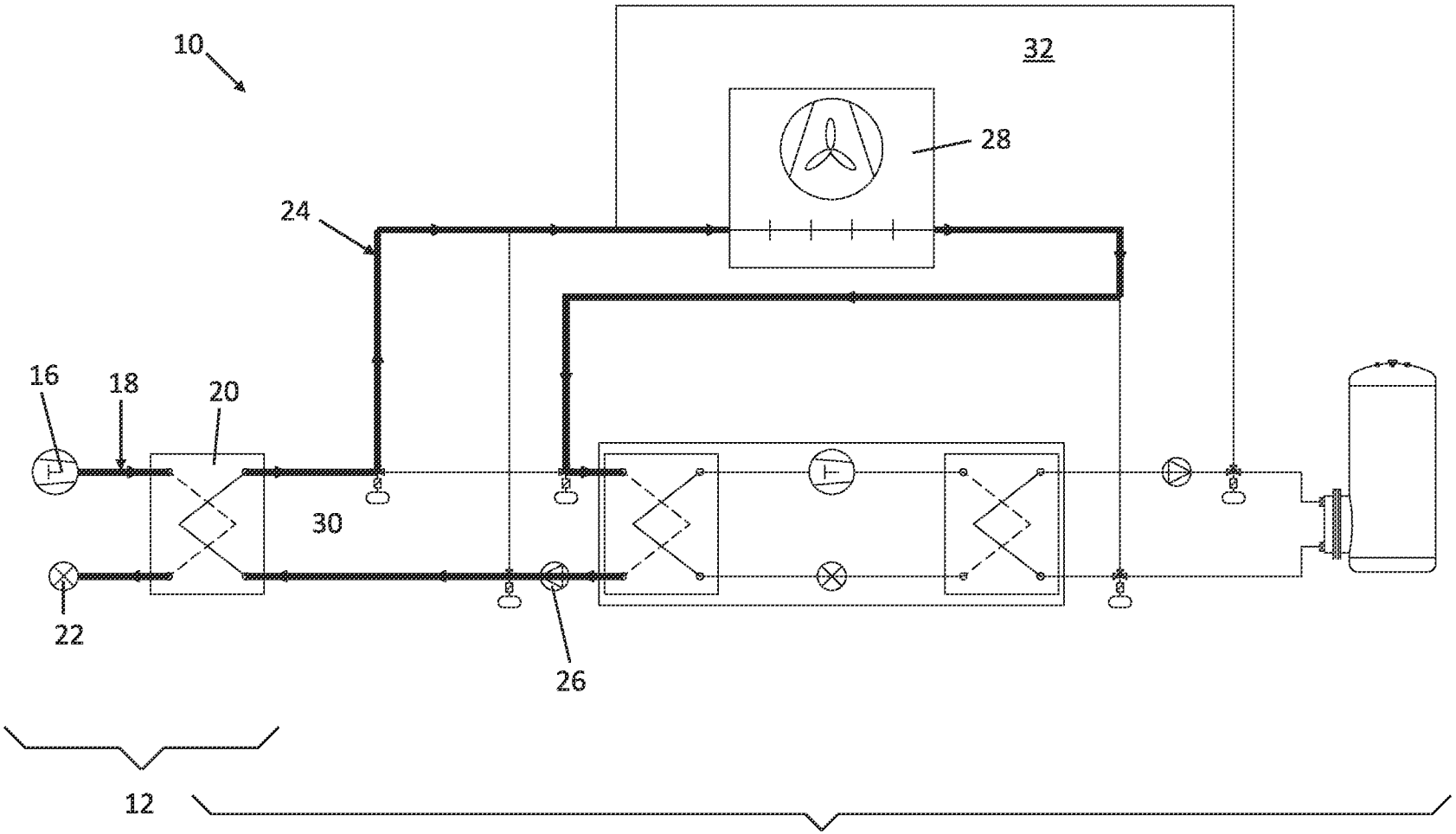

Referring to FIG. 1 of the drawings, a refrigeration system 10 in accordance with the invention comprises a primary refrigeration stage 12 and a secondary stage 14. The primary refrigeration stage 12 comprises an evaporator (not shown) forming the cooling "element" of a refrigeration system (not shown). The primary stage 12 comprises a compressor 16, which pumps and compresses CO2 refrigerant in a closed loop 18 circuit between the evaporator (not shown) and a condenser 20. The closed loop circuit 18 of the primary stage 12 comprises an optional control valve 22 that enables the flow rate within the primary stage 12 to be controlled, whilst the compressor 16 increases the pressure of the CO2 refrigerant in the closed loop circuit 18. Heat is thus drawn from the evaporator of the primary stage 12 and is rejected into the condenser 20 in a manner that will be well-understood by the skilled reader.

The condenser 20 of the primary stage 12 is formed as a plate (or other suitable type of) heat exchanger 20 that thermally couples the primary stage 12 to the secondary stage 14.

The secondary stage 14 comprises a closed-loop water circuit 24 in which a water-based coolant is pumped around the circuit 24 by a pump 26. The circuit 24 comprises a dry air cooler or air side heat exchanger 28, which is located away from the primary stage 12 and which is typically located outside a building—exposed to ambient air. By pumping the water-based coolant around the secondary stage circuit 24 the hot side 30 of the first heat exchanger 20 is cooled by the dry air cooler or air side heat exchanger 28. In conditions where the ambient temperature of the air surrounding the dry air cooler or air side heat exchanger 28 is below about 12° C., heat from the primary stage 12 can be rejected into the first heat exchanger 20 and then rejected into the ambient air 32 surrounding the dry air cooler or air side heat exchanger 28. It will be noted that the CO2 circuit 18 is relatively compact compared with the water circuit 24. The heat pump 36 is passive in this mode.

Figure 2:
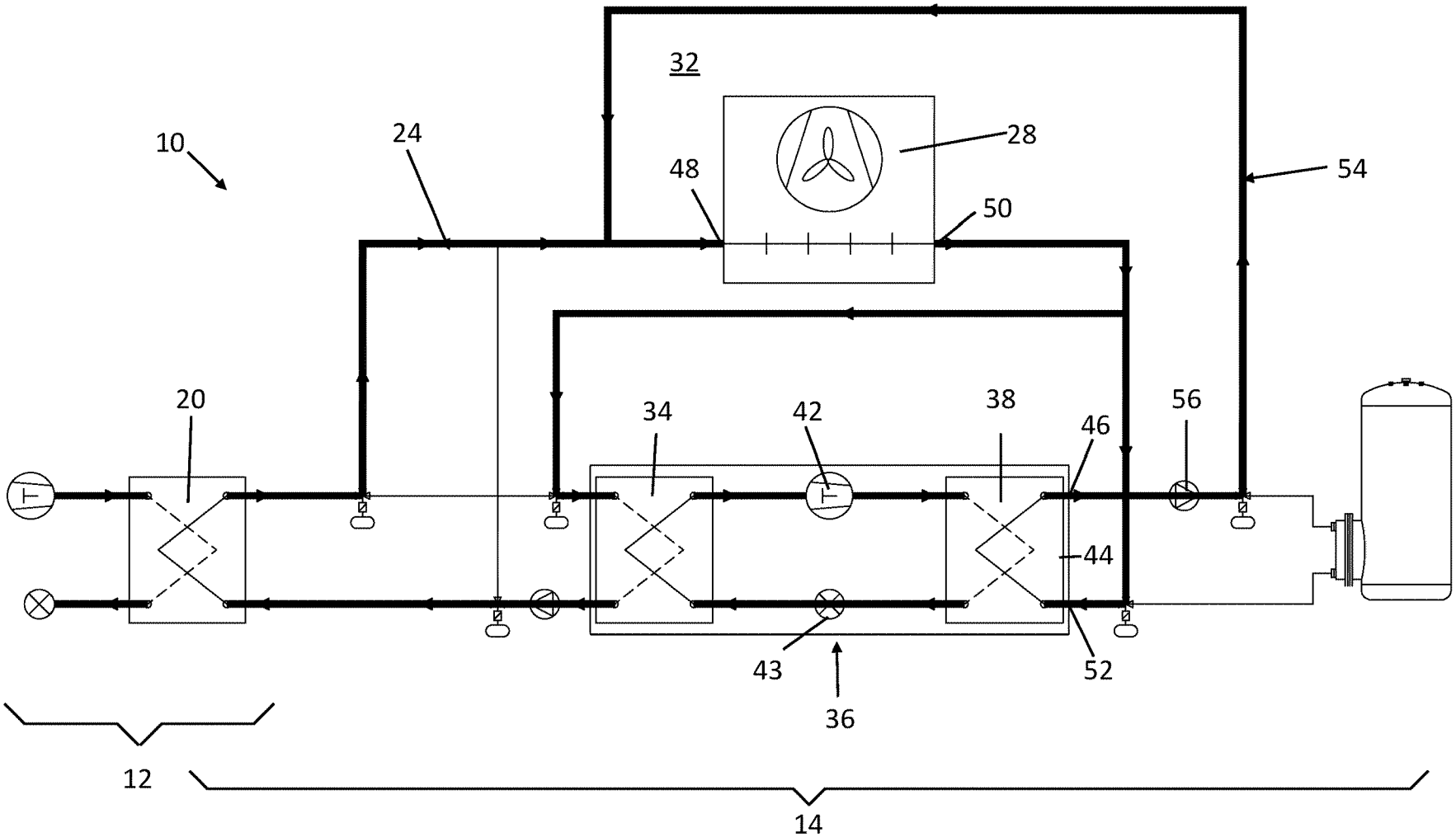

A second mode of operation of the system 10 is shown in FIG. 2 of the drawings in which the ambient temperature 32 surrounding the dry air cooler or air side heat exchanger 28 is moderate, that is to say between about 12 and 30° C. In this situation, the secondary stage circuit 24 is connected in-series with a second heat exchanger 34 forming the evaporator of a heat pump 36. The heat pump 36 comprises a heat pump condenser 38, which is connected to the heat pump evaporator 34 via a closed loop circuit 40. A compressor 42 is provided in the heat pump 36 to compress the refrigerant within the closed loop circuit 42 to upgrade the heat at the heat pump evaporator 34 to an elevated temperature at the heat pump condenser 38. An optional flow control valve 43 is also provided in the heat pump circuit 42 to control the flow rate within that circuit 40. The hot side 44 of the heat pump condenser has an outlet 46, which is connected upstream of the inlet 48 of the dry air cooler or air side heat exchanger 28. The outlet 50 of the dry air cooler or air side heat exchanger 28 is connected to the hot side inlet 52 of the heat pump condenser 38 thereby forming a further circuit 54 in which a water-based coolant flows.

It will be appreciated from the drawings that the water in the cooling circuits 24, 54 mixes and thus the higher-temperature water at the outlet 46 of the hot side 44 of the heat pump condenser 38 is used to pre-heat the water entering the inlet 48 of the dry air cooler or air side heat exchanger 28. What this means, in effect, is that the dry air cooler or air side heat exchanger is able to operate at much higher ambient air temperatures 32 because the requisite temperature differential between the liquid in the dry air cooler or air side heat exchanger 28 and the ambient air 32 is maintained.

It can also be seen in FIG. 2 that a pump 56 is used for pumping water around the circuit 54 and that by varying the relative speeds of the pumps 26 and 56, it is possible to select a desired relative flow rate in the two circuits 24, 54 to ensure that the aforementioned temperature differential at the dry air cooler or air side heat exchanger 28 is maintained.

Figure 3:
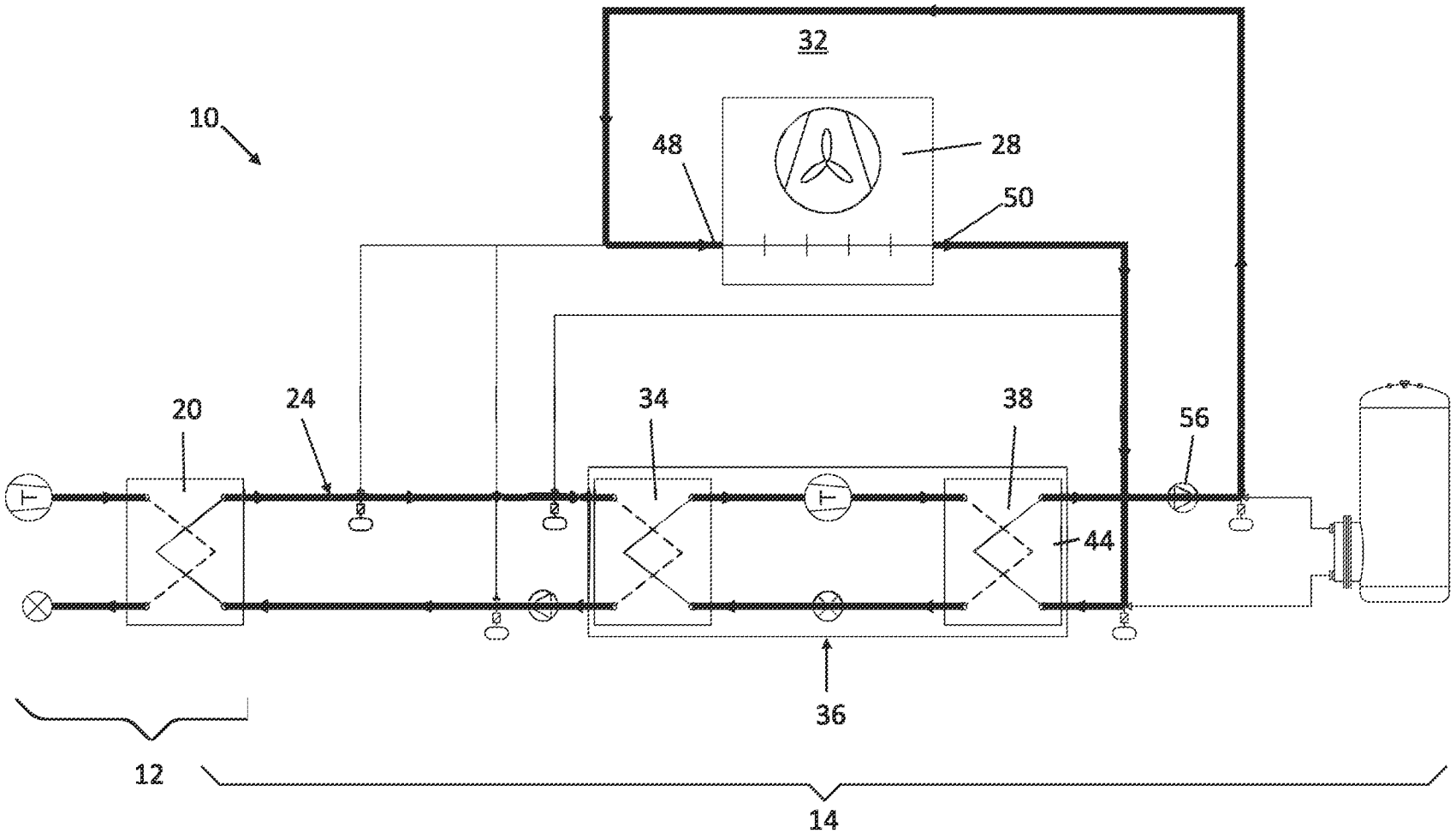

Turning now to FIG. 3 of the drawings, this illustrates the operation of the invention 10 in situations where the ambient air temperature 32 is greater than approximately 30° C. At ambient temperatures exceeding about 30° C., the temperature of the water at the inlet 48 of the dry air cooler or air side heat exchanger 28 must be maintained at a higher temperature than the ambient air temperature 32 and this can be achieved as follows:

In FIG. 3 of the drawings, it can be seen that the dry air cooler or air side heat exchanger 28 has been disconnected from the first water circuit 24. This means that the first heat exchanger 20 rejects its heat directly into the second heat exchanger 34 where the heat pump 36 serves to upgrade the heat to a higher temperature at the hot side hot side 44 of the heat pump condenser 38. Now, by pumping cooling water in the circuit 54 from the high-temperature hot side 44 to the inlet 48 of the dry air cooler or air side heat exchanger, the requisite temperature differential between the water at the inlet 48 of the dry air cooler or air side heat exchanger 28 and the ambient air 32 can be maintained.

Figure 4:
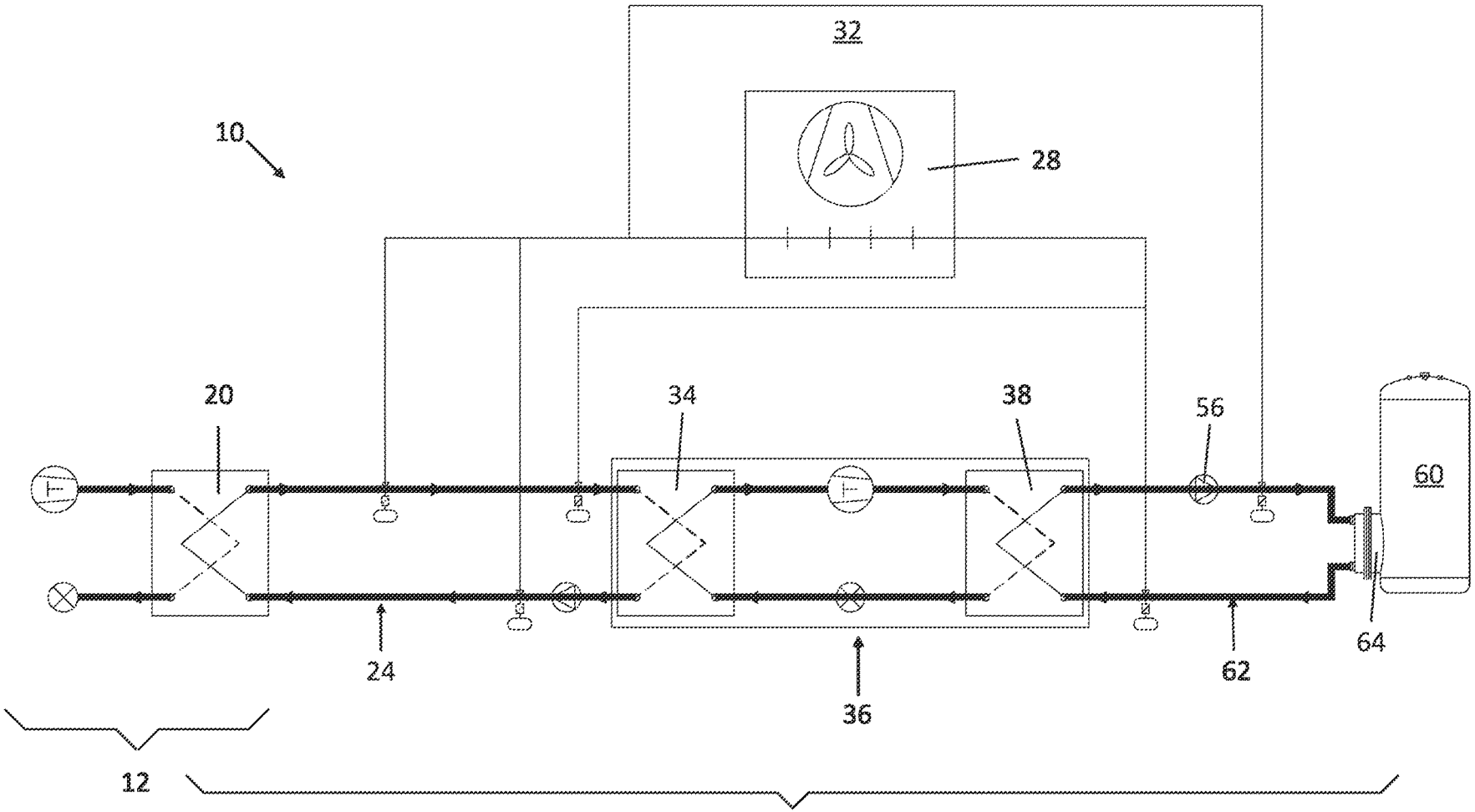

Turning now to FIG. 4 of the drawings, the invention 10 is now being used in a heat recovery mode, whereby instead of the unwanted heat from the primary stage 12 being rejected into the ambient air 32 via the dry air cooler or air side heat exchanger 28, it is now used to heat water in a hot water cylinder 60 (although it will be appreciated that the hot water could be used, for example, in a central heating system instead or as well as in a hot water cylinder).

In FIG. 4 of the drawings, it can be seen that there is a third heat recovery water circuit 62 in which the pump 56 is now used to pump water between the heat pump evaporator 38 and a heat exchanger 64 of the hot water cylinder 60. In this situation, it will be appreciated that heat from the region to be refrigerated in the primary stage 12 is rejected into the first heat exchanger 20, which is maintained at a sufficiently low temperature to keep the CO2 refrigerant within the primary stage 12 at a sub-critical temperature. Heat from the first heat exchanger 20 is then transferred to the second heat exchanger 34, being the heat pump evaporator of the heat pump 36. The heat is then upgraded by the heat pump to a higher temperature at the heat pump condenser 38 and this temperature is sufficient to be useful in hot water and/or central heating applications.

Figure 5:
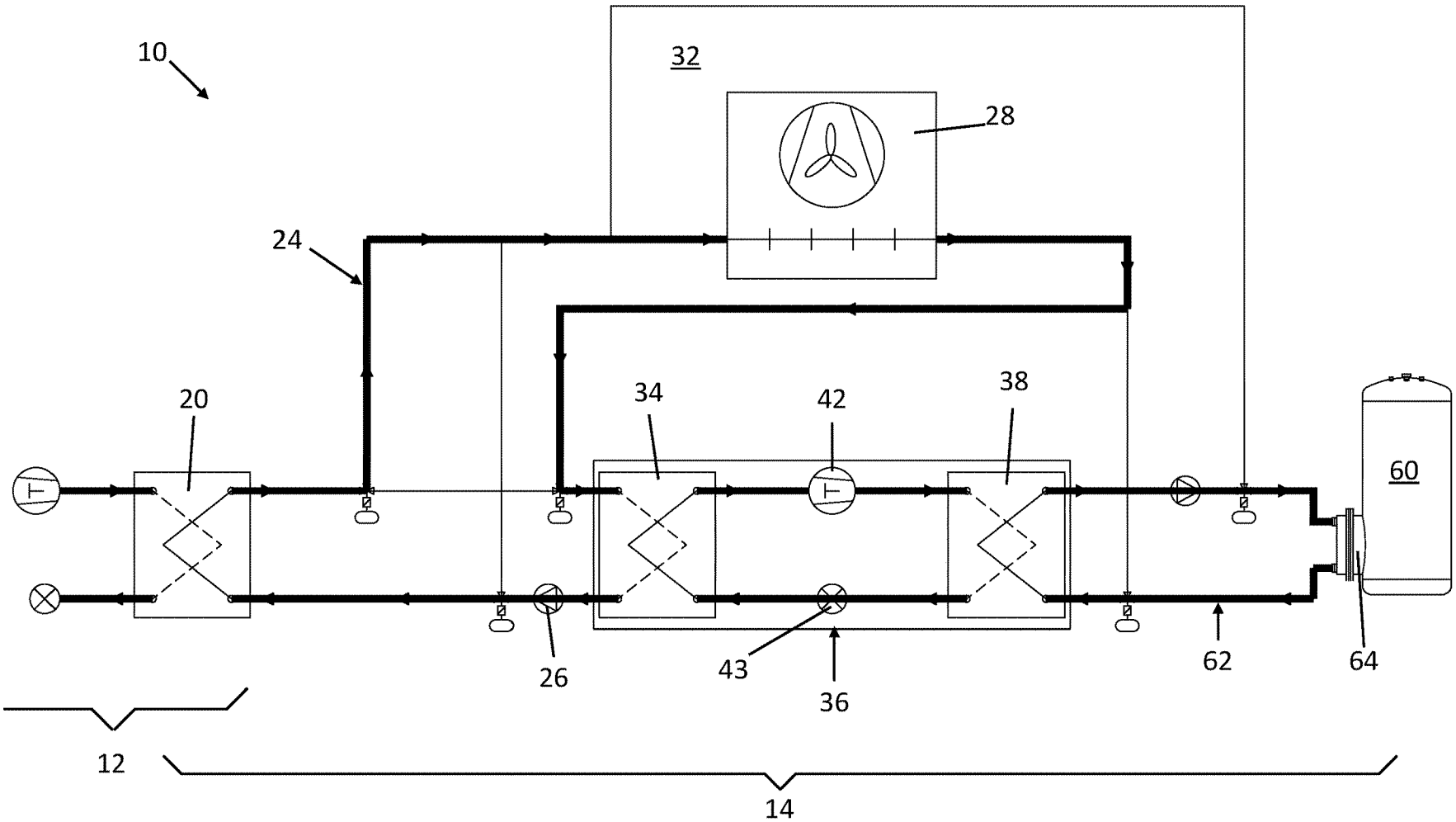

Turning now to FIG. 5 of the drawings, a partial heat recovery mode of the invention 10 is shown in which the first water circuit 24 and the third water circuit 62 are used together. This mode of operation may be employed where the amount of heat to be rejected from the first heat exchanger 20 exceeds the heat requirement at the heat pump condenser 38. In order to reduce the capacity at the heat pump condenser 38, the water entering the heat pump evaporator 34 is pre-cooled using the dry air cooler or air side heat exchanger 28. Specifically, water in the first water circuit 24 is partially cooled by the dry air cooler or air side heat exchanger 28 before it enters the heat pump evaporator 34. The result of this is that the available heat at the heat pump evaporator is lower, thus meaning that the temperature at the heat pump condenser 38 is lower also: thereby reducing the heat recovery output available at the heat recovery system's heat exchanger 64.

It will be appreciated that by varying the speed of the dry cooler fans 28 in the first water circuit 24, the amount of pre-cooling at the heat pump evaporator 34 can be controlled, and thus the temperature at the heat pump condenser 38 can be correspondingly controlled. It will also be appreciated that although the temperatures of the respective water circuits 24, 62 can be controlled, so too can the heat output of the system by controlling the compressor 42 and a control valve 43 of the heat pump 36. In other words, both the relative proportions of heat dissipation via the dry air cooler or air side heat exchanger 28 and the heat recovery heat exchanger 64 can be controlled as well as the temperature in the third water circuit 62.

Figure 6:
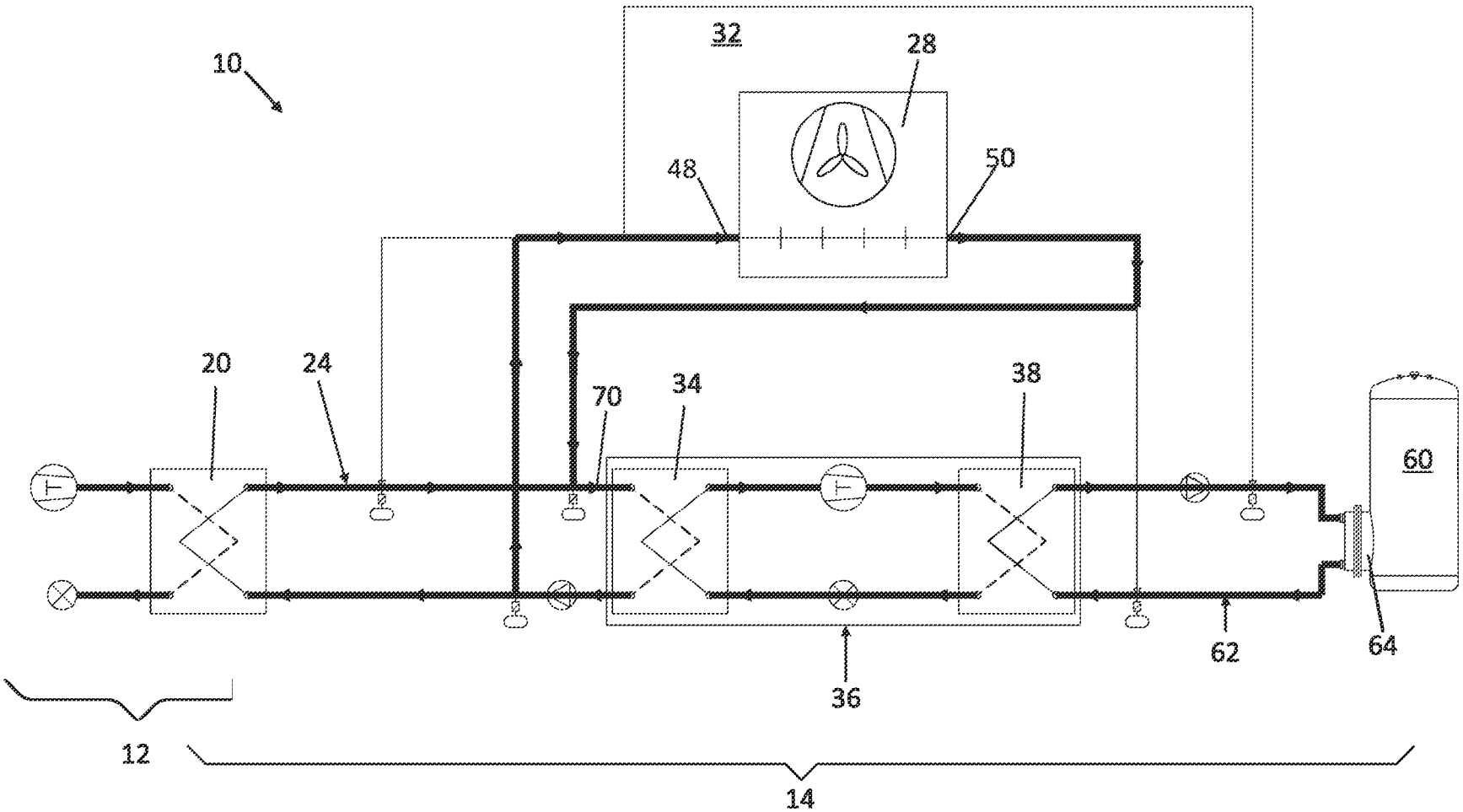

Turning now to FIG. 6 of the drawings, the invention 10 is being used in a heat-scavenging mode with heat recovery as well. The invention may be used in this mode where the demand for heat in the heat recovery system exceeds the available heat output of the primary refrigeration stage 12. In this situation, it is necessary to pre-heat the water in the first water circuit 24 before it enters the heat pump evaporator 34. This is accomplished by connecting the dry air cooler or air side heat exchanger 28 effectively in reverse, so that cooled water enters the inlet 48 of the dry air cooler or air side heat exchanger and is heated by the ambient air 32. It will be appreciated that provided the temperature of the water at the inlet 48 of the dry air cooler or air side heat exchanger is below that of the ambient air 32, the dry air cooler or air side heat exchanger 28 will draw heat from the surrounding air 32 and reject it into the water in the circuit 24. Thus, the temperature of the water at the outlet 50 of the dry air cooler or air side heat exchanger 28 is now hotter than the water at the inlet, and by feeding this pre-heated water back to the inlet 70 of the heat pump evaporator 34, it is possible to put more heat into the heat pump evaporator 34, which can be then used by the heat recovery system.

Figure 7:
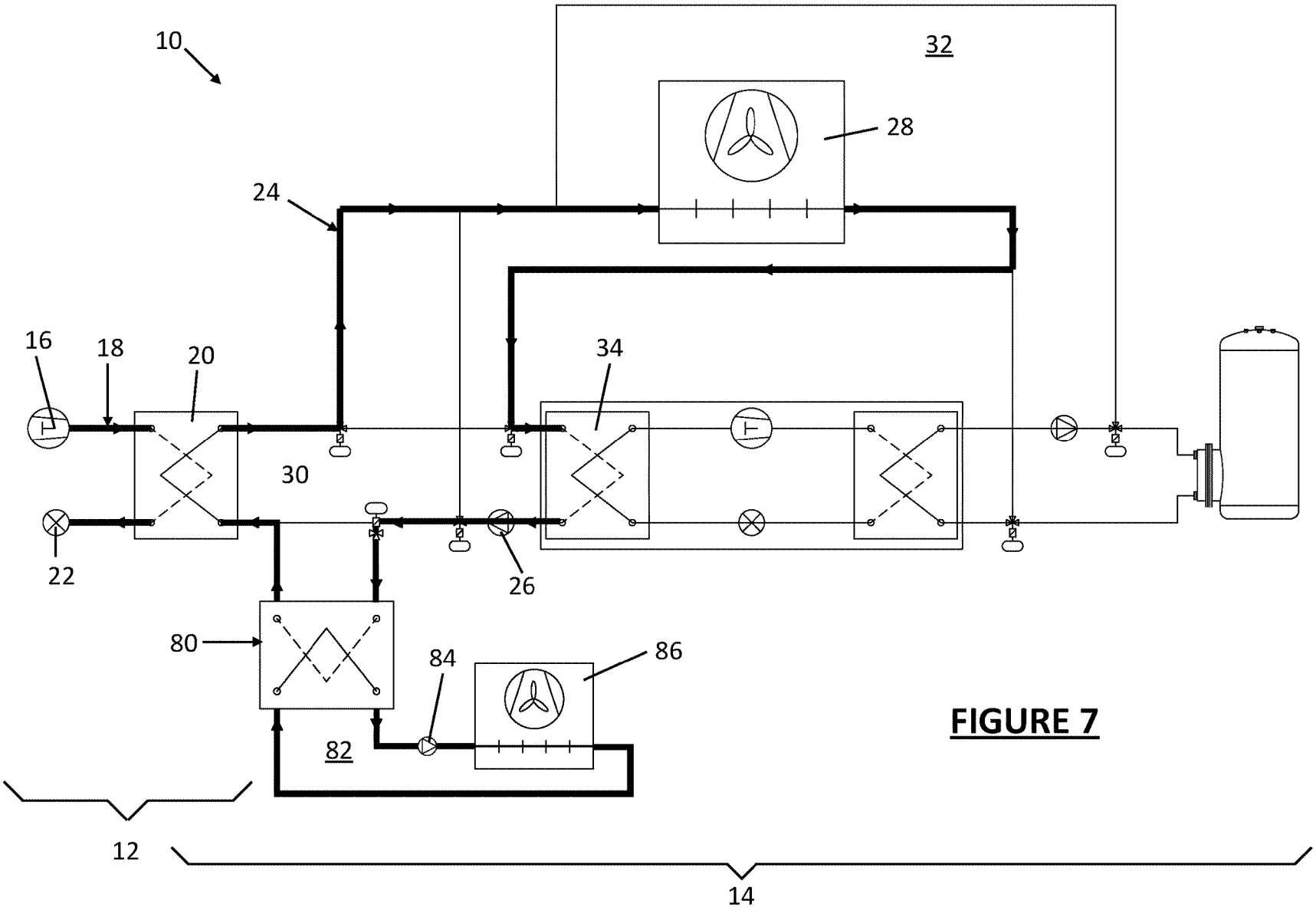
FIG. 7 shows an alternative embodiment of the invention fitted with a third heat exchanger.

Referring to FIG. 7 of the drawings, a refrigeration system 10 in accordance with the invention comprises a primary refrigeration stage 12 and a secondary stage 14. The secondary stage 14, in this embodiment, comprises a further heat exchanger 80 whose hot side 82 comprises a further circuit, comprising a pump 84 and an air side heat exchanger 86, although other heat sinks may be used.

As shown by the flow path, indicated by bold lines in the drawing, this arrangement provides cooling to a water-based air conditioning loop (80, 82, 84, 86), which sits in-series between the second 34 and first 20 heat exchangers.

The following statements are not the claims, but relate to various aspects and/or embodiments of the invention:

Statement 1. A refrigeration system comprising primary and secondary stages thermally coupled to one another via a first heat exchanger; the primary stage comprising: a closed-loop CO2 refrigeration system comprising a primary evaporator located in a region to be cooled, a primary compressor and a water-cooled primary condenser/gas cooler, the primary condenser/gas cooler being, or forming part of, the first heat exchanger and being water-cooled by the secondary stage; the secondary stage comprising a closed-loop fluid cooling system comprising the first heat exchanger, a pump adapted to pump cooling fluid around the secondary stage; and a heat sink.

Statement 2. The refrigeration system of statement 1, wherein the secondary stage comprises a closed-loop water cooling system adapted, in use, to cool the primary condenser/gas cooler.

Statement 3. The refrigeration system of statement 1, wherein the secondary stage comprises a closed-loop refrigeration system in which the pump is a secondary compressor and which comprises a secondary evaporator adapted, in use, to cool the primary condenser/gas cooler, and a heat sink.

Statement 4. The refrigeration system of any preceding statement, wherein the first heat exchanger comprises a plate or shell-and-tube heat exchanger.

Statement 5. The refrigeration system of any preceding statement, wherein the primary stage comprises a closed-loop CO2 refrigeration system in which the primary evaporator, a primary compressor and primary condenser/gas cooler (first heat exchanger) are interconnected by CO2 tubes that are at least partially filled with compressed CO2 fluid.

Statement 6. The refrigeration system of any of statement 1, 2, 4 and 5, wherein the secondary stage comprises a closed-loop water refrigeration system in which the first heat exchanger, pump and heat sink are interconnected by water pipes that are at least partially filled with a water-based refrigerant liquid.

Statement 7. The refrigeration system of statement 6, wherein the water-based refrigerant liquid comprises any one or more of the group comprising: pure water; distilled water; water plus an additive; water plus a surfactant; water plus a heat capacity-altering additive; water plus an anti-corrosion additive; and water plus an anti-freeze additive.

Statement 8. The refrigeration system of any preceding statement, wherein the heat sink comprises any one or more of the group comprising: a dry air cooler; a cooling tower; an evaporative cooler; and a heat exchanger with an air side.

Statement 9. The refrigeration system of any preceding statement, wherein the heat sink comprises supplementary heat extraction means comprising a second heat exchanger forming part of a heat pump connected in-series with the first heat exchanger.

Statement 10. The refrigeration system of statement 9, wherein the heat pump is connected in-series with the dry air cooler.

Statement 11. The refrigeration system of statement 9, wherein the heat pump is connected in-parallel with the dry air cooler.

Statement 12. The refrigeration system of statement 9, 10 or 11, wherein the heat pump comprises an evaporator, being the second heat exchanger; a heat pump compressor; and a heat pump condenser in a heat pump closed-loop circuit, and wherein the heat pump is configured to increase the temperature of a fluid in the heat pump closed-loop circuit at the condenser compared with the temperature of the fluid at the evaporator.

Statement 13. The refrigeration system of statement 12, wherein the cold inlet of heat pump evaporator and the cold inlet of the heat pump condenser are connected to the closed-loop fluid cooling system.

Statement 14. The refrigeration system of statement 12, wherein the hot outlet of the heat pump condenser is operatively connected to the hot side inlet of the dry air cooler, and wherein the cold inlet of the heat pump condenser is operatively connected to the cold side outlet of the dry air cooler.

Statement 15. The refrigeration system of statement 12, 13 or 14, further comprising control means for controlling the relative flow rates of the coolant in the part of the circuit between the first heat exchanger and the dry air cooler; and in the part of the circuit between the heat pump condenser and the dry air cooler.

Statement 16. The refrigeration system of any of statements 1 to 7, wherein the heat sink comprises a second heat exchanger forming part of a heat pump connected in-parallel with the dry air cooler, the heat pump comprising a evaporator, being the second heat exchanger, a heat pump compressor and a heat pump condenser in a closed-loop circuit, and wherein the heat pump is configured to increase the temperature of a fluid in the closed-loop circuit at the condenser compared with the temperature of the fluid at the evaporator, and wherein the hot side outlet of the heat pump condenser is operatively connected to the hot side inlet of a dry air cooler, and wherein the cold side inlet of the heat pump condenser is operatively connected to the cold side outlet of the dry air cooler.

Statement 17. The refrigeration system of statement 16, comprising separate closed loop circuits between the first heat exchanger and the heat pump evaporator (second heat exchanger); and between the heat pump condenser and the dry air cooler, whereby the heat pump is configured to provide an output water temperature at the hot side outlet of the heat pump condenser that is sufficiently higher than ambient air temperature.

Statement 18. The refrigeration system of any of statements 1 to 7, wherein the heat sink comprises a second heat exchanger forming part of a heat pump connected in-parallel with the dry air cooler, the heat pump comprising a evaporator, being the second heat exchanger, a heat pump compressor and a heat pump condenser in a closed-loop circuit, and wherein the heat pump is configured to increase the temperature of a fluid in the closed-loop circuit at the condenser compared with the temperature of the fluid at the evaporator, and wherein the hot side outlet of the heat pump condenser is operatively connected to the hot side inlet of a third heat exchanger of a heat recovery system, and wherein the cold side inlet of the of the heat pump condenser is operatively connected to the cold side outlet of the third heat exchanger.

Statement 19. The refrigeration system of statement 18, wherein the heat recovery system comprises a heat store.

Statement 20. The refrigeration system of statement 19, wherein the heat store comprises a hot water tank.

Statement 21. The refrigeration system of statement 18, wherein the heat recovery system comprises a central heating system.

Statement 22. The refrigeration system of any of statements 18 to 21, further comprising a dry air cooler operatively connected in-series between the first heat exchanger and the evaporator of the heat pump.

Statement 23. The refrigeration system of sentiments 22, wherein the hot outlet of the first heat exchanger is operatively connected to the hot inlet of the dry air cooler, and wherein the cold outlet of the dry air cooler is operatively connected to the cold inlet of the first heat exchanger.

Statement 24. The refrigeration system of any of statements 18 to 21, further comprising a dry air cooler operatively connected in-parallel with the first heat exchanger and the evaporator of the heat pump.

Statement 25. The refrigeration system of statement 24, wherein the cold outlet of the heat pump evaporator is operatively connected to the cold inlet of the dry air cooler, and wherein the hot inlet of the heat pump evaporator is operatively connected to the hot outlet of the dry air cooler.

Statement 26. A refrigeration system substantially as hereinbefore described, with reference to, and as illustrated in any one or more of FIGS. 1 to 6 of the drawings.

It will be appreciated that the invention has been described by way of example only with reference to schematic circuit diagrams and that the precise configuration and arrangement of the pipes and components can be altered without materially departing from the scope of this disclosure, which is defined by the claims. It will also be appreciated that the drawings accompanying this disclosure are schematic in nature and that, for example, where a compressor has been indicated, this could be a multi-stage compressor and/or where a single element (such as the dry air cooler or air side heat exchanger) has been indicated, this could be, in practice a series of dry air cooler or air side heat exchangers (in this example), connected in series or in parallel. The same is true also for the pumps, compressors and heat exchangers shown the schematic drawings and it will be appreciated that a particular system may need to be adapted to meet specific user requirements.

The invention claimed is:

1. A refrigeration system, comprising:

a primary stage; and a secondary stage, the primary stage and the secondary stage being thermally coupled to one another via a first heat exchanger, the primary stage comprising: a closed-loop CO2 refrigeration system comprising a primary evaporator located in a region to be cooled, a primary compressor and a water-cooled primary condenser/gas cooler, the primary condenser/gas cooler forming at least a part of the first heat exchanger and being water-cooled by the secondary stage;

the secondary stage comprising a closed-loop water-based cooling system comprising the first heat exchanger, a pump adapted to pump cooling water around the secondary stage, and a heat sink, the heat sink comprising:

a second heat exchanger forming part of a heat pump connected in-parallel with an air side heat exchanger, the heat pump comprising an evaporator, being the second heat exchanger, a heat pump compressor and a heat pump condenser in a closed-loop circuit, wherein the heat pump is configured to increase a first temperature of a fluid in the closed-loop circuit at the condenser compared with a second temperature of the fluid at the evaporator, a hot side outlet of the heat pump condenser is operatively connected to a hot side inlet of the air side heat exchanger, a hot side inlet of the heat pump condenser is operatively connected to a cold side outlet of the air side heat exchanger, the air side heat exchanger is further connected at least one of (1) in-series between, and (2) in parallel with, the first heat exchanger and the evaporator of the heat pump, a hot side outlet of the first heat exchanger is operatively connected to the hot side inlet of the air side heat exchanger, and the cold side outlet of the air side heat exchanger is operatively connected to a cold side inlet of the first heat exchanger.

2. The refrigeration system of claim 1, further comprising control means for controlling relative flow rates of coolant in a part of a first circuit between the first heat exchanger and the air side heat exchanger; and in a part of a second circuit between the heat pump condenser and the air side heat exchanger.

3. The refrigeration system of claim 2, comprising a further pump for pumping water around a part of the second circuit between the heat pump condenser and the air side heat exchanger, wherein the control means varies relative speeds of the pump and the further pump.

4. The refrigeration system of claim 1, further comprising separate closed loop circuits:

between the first heat exchanger and the heat pump evaporator/second heat exchanger; and between the heat pump condenser and the air side heat exchanger, the heat pump being configured to provide an output water temperature at the hot side outlet of the heat pump condenser that is higher than ambient air temperature such that the output water temperature:

cools the heat pump condenser to cool the hot side of the first heat exchanger to a temperature below a supercritical temperature of the CO2 refrigerant; and increases a temperature at the hot side of the air side heat exchanger to enable the air side heat exchanger to reject heat to the ambient air.

5. The refrigeration system of claim 1, wherein the air side heat exchanger comprises any one or more of the group comprising: a dry air cooler; a cooling tower; and an evaporative cooler.

6. The refrigeration system of claim 1, wherein the first heat exchanger comprises any one or more of the group comprising: a plate heat exchanger; a shell-and-plate heat exchanger; and shell-and-tube heat exchanger.

7. The refrigeration system of claim 1, wherein the cooling water comprises any one or more of the group comprising: pure water; distilled water; water plus an additive; water plus a surfactant; water plus a heat capacity-altering additive; water plus an anti-corrosion additive; and water plus an anti-freeze additive.

8. The refrigeration system of claim 1, wherein the primary evaporator, the primary compressor and the primary condenser/gas cooler are interconnected by CO2 tubes that are at least partially filled with compressed CO2 fluid.

* * * * *